United States Patent [19]

Johnson

[11] Patent Number: 4,838,059

[45] Date of Patent: Jun. 13, 1989

[54] COMBINED COVER AND ATTACHING MEANS FOR CONCEALING A DEADBOLT LOCK

[76] Inventor: Gordon E. Johnson, P.O. Box 778, Cando, N. Dak. 58324

[21] Appl. No.: 217,661

[22] Filed: Jul. 11, 1988

[51] Int. Cl.[4] ..... E05B 13/00

[52] U.S. Cl. ..... 70/209; 70/163; 70/427

[58] Field of Search ..... 70/428, 427, 423, 424, 70/425, 426, 237, 209, 158–173, 181

[56] References Cited

U.S. PATENT DOCUMENTS

| | | | |
|---|---|---|---|
| 3,635,057 | 1/1972 | Foote | 70/424 |
| 3,636,742 | 1/1972 | Raney | 70/424 |
| 3,866,445 | 2/1978 | Erwin | 70/428 |
| 4,123,924 | 11/1978 | Daorkis | 70/428 |
| 4,561,273 | 12/1985 | Robinson | 70/424 |
| 4,631,938 | 12/1986 | Johnson | 70/427 |

*Primary Examiner*—Robert L. Wolfe

*Attorney, Agent, or Firm*—Peterson, Wicks, Nemer & Kamrath

[57] ABSTRACT

A hinged cover encloses a projecting portion of a deadbolt lock, the projecting portion having a keyhole therein. The cover includes two shells, each having an inwardly directed flange thereon. By means of a retainer unit provided with a groove, the flanges are received in the groove to prevent removal of the cover when an auxillary lock is employed to keep the cover in its mated relationship so as to conceal the projecting portion of the deadbolt lock and the keyhole contained therein.

10 Claims, 1 Drawing Sheet

COMBINED COVER AND ATTACHING MEANS FOR CONCEALING A DEADBOLT LOCK

BACKGROUND OF THE INVENTION

This invention relates generally to deadbolt locks, and pertains more particularly to a removable cover and means for attaching the cover in a concealing relation with a deadbolt lock.

Deadbolt locks, which are commonly used nowadays, provide an optimum degree of protection against intruders. The deadbolt locks can be opened only with a key, whereas other types of locks are vulnerable to being opened with flexible cards and various tools.

Nonetheless, even though a deadbolt lock affords considerable protection against unauthorized entry, if a person has an appropriate key, the deadbolt lock can be unlocked with such a key. On the other hand, if the face of the deadbolt lock is concealed by a cover, then the would-be burglar cannot ascertain immediately whether he has an appropriate key for that particular deadbolt lock. Where the deadbolt lock is concealed, then the burglar is deterred to a greater degree than if the keyhole in the deadbolt lock is visible to him.

SUMMARY OF THE INVENTION

Therefore, an important object of my invention is to conceal the face of a deadbolt lock so that the burglar or other unauthorized person attempting to gain entry cannot readily ascertain if he possesses a proper key for that particular deadbolt lock. Actually, the would-be burglar does not even know for sure that there is a deadbolt lock on the door through which he seeks entry into the building and is uninformed as to whether any security system is involved because the cover not only conceals the deadbolt lock but also creates a high degree of uncertainly with respect to what might be covered in addition to the deadbolt lock.

Although the chief purpose of my invention is to appropriately conceal a deadbolt lock, another object is to provide a ready means for attaching a cover in an overlying relationship with the deadbolt lock without disfiguring the door on which the deadbolt lock is installed. In other words, an aim of the invention is to avoid using screws that would be unsightly and which would leave holes if the cover is removed, as well as having any parts contact the door that would be likely to mar the door's surface.

Yet another object of my invention is to provide a combined cover and means for attaching the cover in an overlying relationship with the deadbolt lock to be concealed that can be fabricated at a relatively low cost and sold at a comparatively low price, thereby encouraging its use by those who have employed deadbolt locks for protection.

Another object is to provide a combined cover and attaching means therefor that can be employed in conjunction with deadbolt locks that have already been installed.

Still further, an object is to provide a cover and attaching means therefor that can be used with a variety of deadbolt locks types.

Briefly, my invention includes a hinged cover comprised of two mateable shells, each of which has an arcuate flange thereon which flanges engage in a groove provided by a slotted retainer unit that is clamped between the door and the escutcheon or rose plate belonging to the deadbolt lock. The slot in the retainer unit permits the unit to be readily inserted when the mounting bolts of the deadbolt lock extending through the door are sufficiently loosened if the deadbolt lock has already been installed or readily added if the deadbolt lock is being initially installed. After the arcuate flanges have been engaged in the groove of the retainer unit, an auxillary lock is then employed to hold the shells in their mated and concealing relationship, the arcuate flanges now residing in the groove preventing any removal of the cover until the auxillary lock has first been unlocked.

DESCRIPTION OF THE PREFERRED EMBODIMENT

Figure 1:
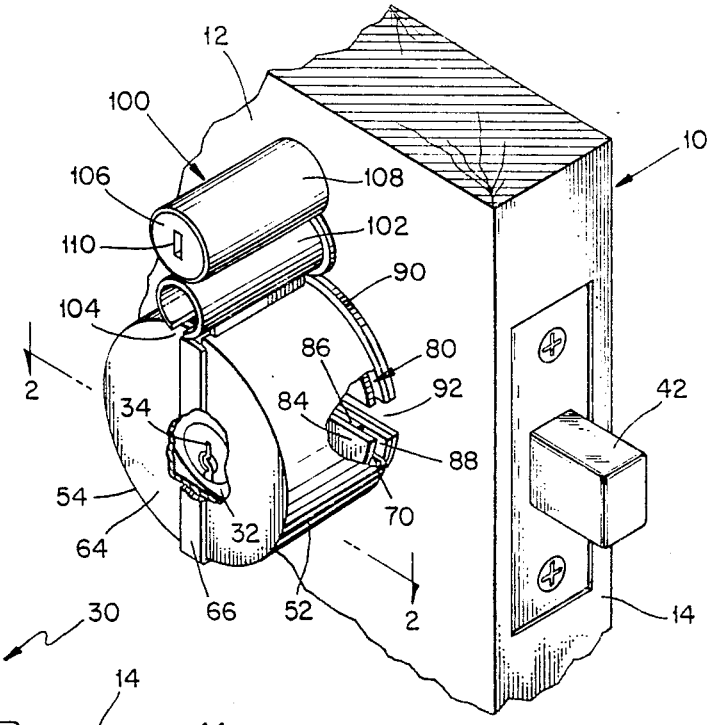
FIG. 1 is a fragmentary perspective view of a door having a conventional deadbolt lock installed thereon with my cover attached thereto, a first portion of the cover having been broken away in order to expose to view the keyhole of the deadbolt lock and a second portion of the cover having been broken away in order to reveal a segment of the grooved retainer unit that holds the cover in place.
Figure 2:
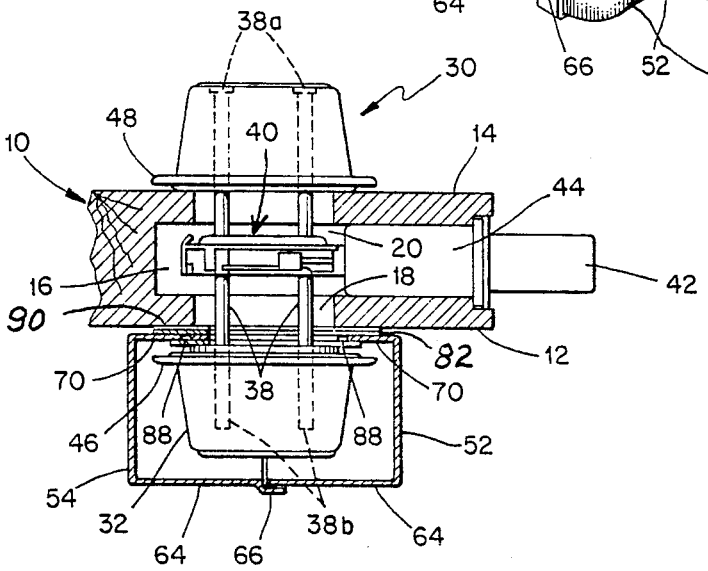
FIG. 2 is a horizontal sectional view taken in the direction of line 2—2 of FIG. 1.

Referring first to FIGS. 1 and 2, it will be seen that a portion of a wooden door 10 has been pictured, the door having an outer side labelled 12 and an inner side labelled 14. From FIG. 2, it will be observed that the door has a recess 16 formed therein, a first circular opening 18 leading from the outer side 12 into the recess 16 and a second circular opening 20 leading from the inner side 14 into the recess 16.

A conventional double cylinder deadbolt lock has been denoted generally by the reference numeral 30. The lock comprises a portion 32 projecting from the outer side 12 of the door 10 having a keyhole 34 therein and a portion 36 projecting from the inner side 14 of the door 10 which would also have a keyhole that need not be concealed because it is on the room side of the door 10. The portions 32 and 36, each including a casing, are held in place with respect to the door by reason of a pair of studs or bolts 38 that extend through the door's recess 16, these studs or through bolts 38 having heads **38*a* that are accessed from the interior or inner side 14 of the door 10 and having threaded end portions 38*b* that are engaged in the outer portion 32 of the deadbolt lock 30**.

Within the recess 16 and constituting a part of the deadbolt lock 30 is a mechanism 40 that actuates the sliding bolt 42 that is reciprocally disposed in a casing 44 fitted within a portion of the recess 16.

For the sake of completeness, reference will be made to an escutcheon or rose plate 46 constituting an integral part of the projecting portion 32 and a similar plate 48 constituting an integral part of the projecting portion 36.

Only a sketchy description of the deadbolt lock 30 has been presented in that my invention is usable with deadbolt locks of varying construction. For instance, the pictured deadbolt lock 30 is a double cylinder one, but a single cylinder one can equally well make use of my invention in that my invention is concerned only with the external or outer projecting portion 32, it being immaterial as to how the lock 30 is actuated from the inner side 14.

Describing now the cover that conceals the keyhole 34, it will be observed that this cover has been indicated generally by the reference numeral 50. The cover 50 is comprised of two semicylindrical shells 52 and 54 hinged together at 56. Each shell 52 and 54 has an integral semicylindrical head 58 thereon having a relatively thin neck at 60 and notch located at 62.

Each shell 52 and 54 is provided with a semicircular panel 64, the panel 64 on the shell 52 having an offset flange 66 that overlies the edges of the shells 52 and 54 when the cover 50 is closed, as can be understood from FIG. 2. Playing an important role in the practicing of my invention is an inwardly extending arcuate flange 70 at the end of each shell 52 and 54 that is opposite the end having the panel 64 thereon.

Also of importance in practicing my invention is a retainer unit indicated generally by the reference numeral 80. The unit 80 includes a first larger circular disc 82 and a second smaller circular disc 84 with a spacer 86 therebetween, the spacer 86 being even smaller in diameter than that of the disc 64 so as to provide an annular groove 88 for receiving the arcuate flanges 70 therein when the cover 50 is closed, that is, when the shells 52 and 54 are mated. The spacer 86 is permanently secured to the adjacent sides of the discs 82 and 84 to form a groove 88. Additionally, there is a layer of felt 90 adhered to the other face of the larger disc 82 so as to not mar or disfigure the outer side 12 of the door 10. In this way, should the retainer unit 80 later be removed, the door 10 will not have been scratched by reason of the retainer unit 80 having been clampingly attached in place on the door 10.

Figure 4:
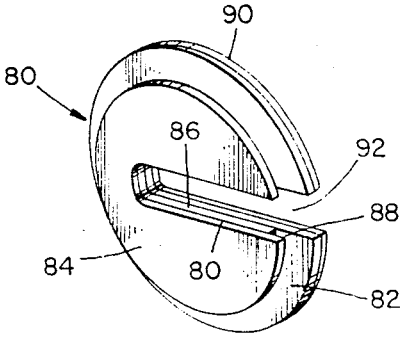
FIG. 4 is a perspective view of just the grooved retainer unit alone.

Attention is directed at this time to a slot 92 in the retainer unit 80. Actually, the slot 92 is composed of individual slots in each of the members 82, 84, 86 and 90 but is being referred to as a single slot 92 in that the members 82, 84, 86 and 90 are integrally connected together to form the retainer unit 80. From FIG. 4 it will be observed that the slot 92 extends radially inwardly from the periphery of the unit 80.

Reference will now be made a keeper unit 100 that includes a tube 102 having a slot 104 therein which receives the previously mentioned neck 60 when the tube 102 is telescopically slid over the semicylindrical heads 58 on the two shells 52 and 54. It will be understood that the shells 52 and 54 are retained in a mated relationship once the keeper unit 100 has been applied.

Additionally, there is a cylindrical lock 106 that is integrally attached to the tube 102 of the keeper unit 100. The cylindrical lock 106 constitutes an auxillary lock, having a barrel 108. The barrel 108 has a keyhole at 110. Although not shown in the drawings, it can be pointed out that the lock 106 has a bolt that is projectable downwardly into the notches 62 formed on the semicylindrical heads 58 on the shells 52 and 54.

Although the description herein given with respect to the keeper unit 100 and the cylindrical lock 106 is believed adequate for an understanding of the present invention, should additional information concerning these components be desired, reference may be made to my U.S. Pat. No. 4,631,938 issued on Dec. 30, 1986 titled "Accessory Locking Device For A Doorknob Having A Keyhole Therein."

Having presented the foregoing description, the benefits to be derived from my invention should be readily appreciated. Nonetheless, a brief summary of what has been set forth will help to provide a more complete understanding. With this in mind, it will be assumed that the deadbolt lock 30 has already been installed on the door 10. In such a situation, the user of my invention need only loosen the studs or through bolts 38 with a screwdriver applied to the heads 38*a*.

Sufficient loosening of the studs or through bolts 38 will permit the insertion of the retainer unit 80 between the outer side 12 of the door 10 and the rose plate 46 belonging to the projecting portion 32, the slot 92 in the retainer unit 80 permitting intermediate portions of the studs or bolts 38 to be received therein. Thus, it is not at all essential that the studs 38 or bolts be completely removed, it only being necessary that they be loosened sufficiently.

Once the retainer unit 80 has been sandwiched in between the side 12 of the door 10 and the rose plate 46 the studs 38 can be retightened so that the retainer unit 80 is clamped securely in place.

Figure 3:
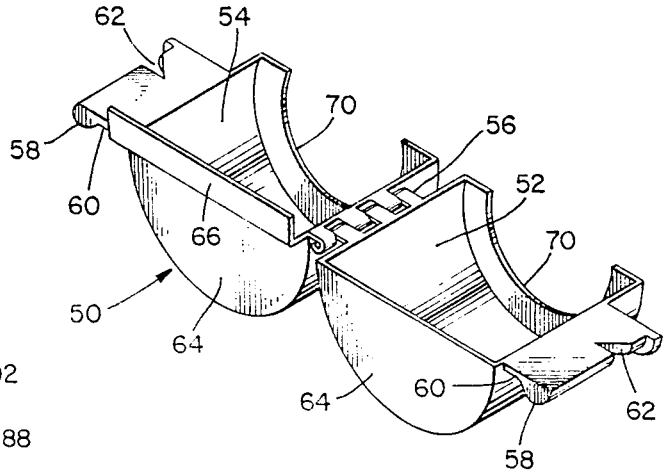
FIG. 3 is a perspective view of the cover with the shells thereof swung into an open or 180° relationship.

With the retainer unit 80 in place, the retainer unit 80 is ready for the attachment of the cover 50. All that the user need do is to swing the cover 50 from its open position as it appears in FIG. 3 into the closed position in which it appears in FIGS. 1 and 2, making certain that the arcuate flanges 70 enter the groove 88 formed by reason of the spacing of the discs 82 and 84 by the spacer 86 secured therebetween.

With the arcuate flanges 70 engaged or received in the groove 88, all that need be done at this time is to apply the keeper unit 100 by slipping the tube 102 thereof over the semicylindrical heads 58, as is done in my said patent. Thereafter, the key for the cylindrical lock 106 can be inserted in the keyhole 110 so as to prevent retraction of the bolt (not shown) from the notches 62 in the semicylindrical heads 58.

In this way, the combined cover 50 and the attaching means consituting the retainer unit 80 assures complete concealment of the deadbolt lock 30, more specifically its projecting portion 32 having the keyhole 34 therein. Thus, any burglar or intruder would not know what is being concealed and would also not know for certain whether an alarm is hidden within the cover 50 when locked in its closed and concealing relationship with the portion 32 of the deadbolt lock 30. Stated somewhat differently, the would-be burglar or intruder would have to first remove the cover 50 which is a chore in and of itself in order to ascertain that there is even a deadbolt being concealed, and then he would have to have with him the proper key that would fit the keyhole 34 for unlocking the deadbolt lock 30. Without first having removed the cover 50, the burglar or other unauthorized person has no way of knowing what key would fit in the keyhole 34 of the deadbolt lock 30. Hence, the burglar is deterred from entering the building through the door 10 because of his lack of knowledge as to what key would be appropriate for unlocking the deadbolt lock 30, assuming that he even recognizes that the cover 50 is concealing a deadbolt lock.

Of course, on occasion it may be that the cover 50 will not be needed, such as when a person is home and is expecting an authorized person or another occupant of the dwelling to arrive. The cover 50, in such a situation, is easily detached and removed from the retainer unit 80. The retainer unit 80 without the cover unit 50 applied thereto is virtually unnoticeable and does not detract from the door's appearance. On the other hand, when an occupant is leaving the building equipped with my cover 50 and retainer unit 80, the cover 50 can very easily be applied and once applied locked in place by virtue of the cylindrical lock 106. In other words, my combined cover and attaching means can be made use of as circumstance dictates inasmuch as the cover 50 can be readily removed whenever concealment of the deadbolt lock 30 is not needed or desired.

I claim:

1. The combination of a door and deadbolt lock having a portion thereof projecting from one side of the door, said projecting portion having a keyhole therein, a cover for concealing said keyhole including a pair of shells for enclosing said projecting portion, at least one of said shells having an inturned flange having a predetermined thickness, fixed means positioned relative to said door forming a groove having a width slightly greater than the thickness of said flange for receiving said flange therein, and means for maintaining said shells in a mated or closed relationship with each other when said flange is received in said groove so that said mated shells conceal and block access to said keyhole.

2. The combination of a door and deadbolt lock having a portion thereof projecting from one side of the door, said projecting portion having a keyhole therein, a cover for concealing said keyhole including a pair of shells for enclosing said projecting portion, at least one of said shells having an inturned flange, fixed means positioned relative to said door including first and second disc members and a spacer member therebetween, said spacer member being secured to said disc members to form a groove for receiving said flange therein, and means for maintaining said shelves in a mated or closed relationship with each other when said flange is received in said groove so that said mated shells conceal and block access to said keyhole.

3. The combination of claim 2 in which said first disc member confronts said door and is larger than said second disc member.

4. The combination of claim 2 in which said retainer unit has a slot therein, the deadbolt having a pair of studs or bolts extending through the door and portions of said studs or bolts being received in said slot.

5. The combination of claim 4 in which said retainer unit has a layer of felt thereon, the layer of felt facing a portion of one side of said door.

6. A retainer unit for retaining a hinged cover in a concealing relation with a projecting portion of a deadbolt lock comprising first and second disc members and a spacer member therebetween, said spacer member being secured to said first and second disc members so as to form a groove in said retainer unit.

7. The retainer unit of claim 6 in which said retainer unit has a radially extending slot therein.

8. The retainer unit of claim 7 in which said first disc member is larger than said second disc member.

9. The retainer unit of claim 8 including a layer of felt on the side of said first disc member opposite the side thereof to which said spacer member is secured.

10. The combination of claim 1 in which said fixed means includes at least one disc member closely adjacent said door, said disc member providing obstructive engagement with said flange to prevent withdrawal of said shells when said flange is received in said groove.

* * * * *